United States Patent [19]

Singelyn et al.

[11] Patent Number: 4,643,108

[45] Date of Patent: Feb. 17, 1987

[54] APPARATUS FOR DEHYDRATING METAL HYDROXIDE SLUDGE

[76] Inventors: Daniel D. Singelyn; Paul J. Singelyn, both of 133 Lyle La., Nashville, Tenn. 37210

[21] Appl. No.: 815,983

[22] Filed: Jan. 3, 1986

[51] Int. Cl.[4] ..... F23G 5/04

[52] U.S. Cl. ..... 110/228; 34/182; 110/257; 241/152 A; 241/154; 241/235

[58] Field of Search ..... 110/218, 219, 222, 224, 110/227, 228, 232, 255, 257, 258, 110; 34/182; 241/152 A, 154, 158, 159, 235

[56] References Cited

U.S. PATENT DOCUMENTS

| | | | |
|---|---|---|---|
| 569,821 | 10/1896 | Dickson | 241/152 A |
| 3,044,182 | 7/1962 | Steffen | 34/182 |
| 3,109,392 | 11/1963 | Riepl et al. | 110/222 |
| 3,702,596 | 11/1972 | Winther | 110/224 |
| 3,744,145 | 7/1973 | Maxwell et al. | 110/227 X |
| 3,910,775 | 10/1975 | Jackman | 110/222 X |
| 3,981,455 | 9/1976 | Kaczmarek | 241/152 A X |
| 4,338,869 | 7/1982 | Hoskinson | 110/257 X |
| 4,504,222 | 3/1985 | Christian | 110/228 X |

*Primary Examiner*—Albert J. Makay
*Assistant Examiner*—Steven E. Warner
*Attorney, Agent, or Firm*—Harrington A. Lackey

[57] ABSTRACT

A method and apparatus for dehydrating a metal hydroxide sludge, including depositing the concentrated metal hydroxide sludge containing approximately 60–80% water into a feed hopper, breaking up the concentrated sludge with rotary beaters and preferably a rotary breaker bar, then transferring the broken sludge through a feed auger to an elongated dehydrater chamber in which the sludge is conveyed longitudinally along the dehydrater chamber by a dryer auger continuously in contact with a longitudinally flowing hot gas. The moisture-laden hot gas is exhausted from the outlet end of the dehydrater chamber while the dryed sludge is deposited through a discharge port.

6 Claims, 5 Drawing Figures

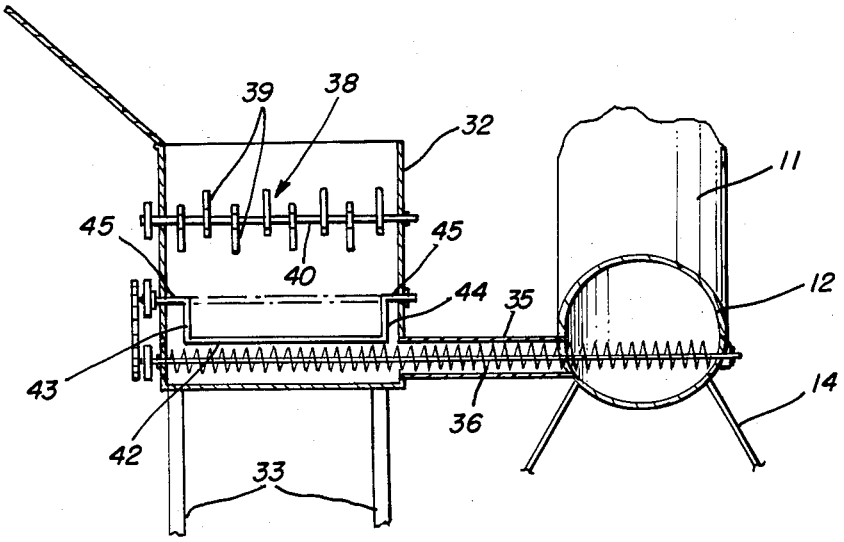
FIG. 3
FIG. 4
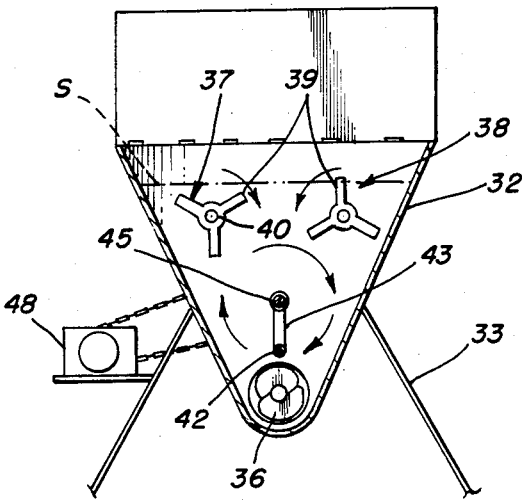
FIG. 5
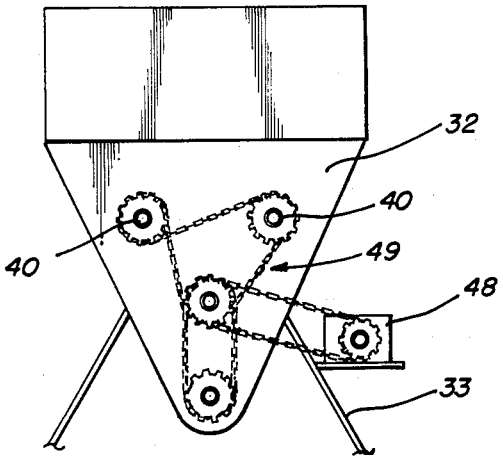

APPARATUS FOR DEHYDRATING METAL HYDROXIDE SLUDGE

BACKGROUND OF THE INVENTION

This invention relates to a method and apparatus for dehydrating sludge, and more particularly to an apparatus for continuously dehydrating metal hydroxide metal sludge.

Metal hydroxide sludges containing approximately 60–80% water, most of which is in the form of water of hydration, are produced as waste products in metal finishing processes. Typically, the waste metal hydroxide sludge is concentrated by a centrifuge, a vacuum filter, a pressure filter, or a filter press. The disposal of the concentrated metal hydroxide sludge is facilitated by the removal of water from the sludge to create a chemically more stable sludge and to reduce both the volume and weight of the sludge, thereby minimizing disposal costs.

Water is typically removed from metal hydroxide sludge in a batch process. A large volume of wet sludge is deposited into the drying chamber or oven in which the large mass of sludge is subjected to relatively small volumes of hot air, the air must be forced rapidly into surface contact with the sludge in order to adequately dry the sludge. Ideally, the air flow must be greater at the beginning of the batch drying process than at the end, gradually decreasing as the volume of water is removed from the sludge. As a practical matter, some intermediate constant air flow rate is utilized during the drying process. After the large volume of sludge is dried, material handling equipment, such as a forklift, is required to load and unload the drying oven.

If a constant air flow is applied to the batch of sludge, excessive drying toward the end of the cycle produces an increasing amount of dust. Accordingly, a dust removal system is required, such as a filter system or centrifuges.

Various types of drying apparatus incorporating elongated tubular chambers through which the treated material is moved by a spiral conveyer and through which heated air or hot gases are passed to dry the material are shown in the following U.S. patents:

| | | |
|---|---|---|
| 245,274 | Byerly | Aug. 9, 1881 |
| 676,165 | Wacker | Jun. 11, 1901 |
| 1,371,546 | Bollmann | Mar. 15, 1921 |
| 1,459,923 | Nagel | Jun. 26, 1923 |
| 1,478,347 | Mitchell | Dec. 18, 1923 |
| 1,538,385 | Daman | May 19, 1925 |
| 2,067,506 | Silva | Jan. 12, 1937 |
| 2,122,857 | Carlson | Jul. 5, 1938 |
| 3,347,533 | Mauldin | Oct. 17, 1967 |
| 3,678,596 | Kubo | Jul. 25, 1972 |
| 4,156,392 | Bayeh | May 29, 1979 |
| 4,176,465 | Murray, et al. | Dec. 4, 1979 |

The Bylerly U.S. Pat. No. 245,174, discloses a feed hopper having a feed auger in combination with the dryer chamber.

However, none of the above patents discloses the specific process and apparatus of this invention for deydrating metal hydroxide sludges continuously, and particularly do not teach the utilization of a feed hopper for breaking up concentrated wet metal hydroxide sludge before it is introduced into the dehydrater chamber.

SUMMARY OF THE INVENTION

It is therefore an object of this invention to provide a method and apparatus for continuously dehydrating a metal hydroxide sludge, such as concentrated metal hydroxide sludge produced as a waste product in the metal finishing industry.

In the method of dehydrating metal hydroxide sludge, in accordance with this invention, the sludge, which is normally concentrated in a waste treatment process in the metal finishing industry, is deposited into a feed hopper equipped with rotary beaters and a rotary breaker bar for loosening, breaking up and separating the wet concentrated sludge to facilitate the sludge gravitating toward the bottom of the hopper so that the sludge may be transferred from the bottom of a hopper by a feed auger into the inlet end of an elongated, tubular chamber. The wet sludge in the dehydrater chamber is fed upwardly along a gradual incline by a dryer auger in the bottom of the tubular dehydrater chamber toward its upper outlet end. Gas or air is heated to approximately 300°–1600° F. and forced into the inlet end portion of the dehydrater chamber, so that the hot air moves continuously along the chamber and in intimate contact with the upward moving sludge for the full length of the dehydrater chamber. At the outlet end of the chamber, the moisture-laden hot gases are vented from the outlet end portion of the chamber, while the dry sludge is deposited through a discharge port into a discharge receptacle for subsequent removal by conveyer or other means.

The dryer auger occupies a relatively small amount of the cross-sectional area of the dehydrater chamber and is designed to move the sludge relatively slowly up the length of the chamber to provide greater opportunity for drying contact with the hot gases. Typically, the ratio of the hot gas or air within the dehydrater chamber to the sludge is approximately 5:1–50:1. This relatively high proportion of hot gas to sludge affords more rapid drying of the sludge.

The rotary breaker device or mechanism utilized in the feed hopper to facilitate the feeding of the wet sludge includes a rotary breaker bar in the lower portion of the hopper directly above the feed auger. The rotary breaker bar is parallel to its rotary horizontal axis, which is also preferably parallel to the longitudinal axis of the feed auger. The rotary breaker bar is driven to completely sever and separate a lower portion of the concentrated sludge, so that the severed portion is completely unsupported and will fall by its own weight into the hopper for feeding into the dehydrater chamber.

BRIEF DESCRIPTION OF THE DRAWINGS

FIG. 3 is a longitudinal section of the feed hopper and a transverse section of the dehydrater chamber, taken along the line 3—3 of FIG. 1;

FIG. 4 is an enlarged transverse section of the feed hopper taken along the line 4—4 of FIG. 1; and FIG. 5 is a rear-end elevational view of the feed hopper, taken along the line 5—5 of FIG. 1.

DESCRIPTION OF THE PREFERRED EMBODIMENT

Figure 1:
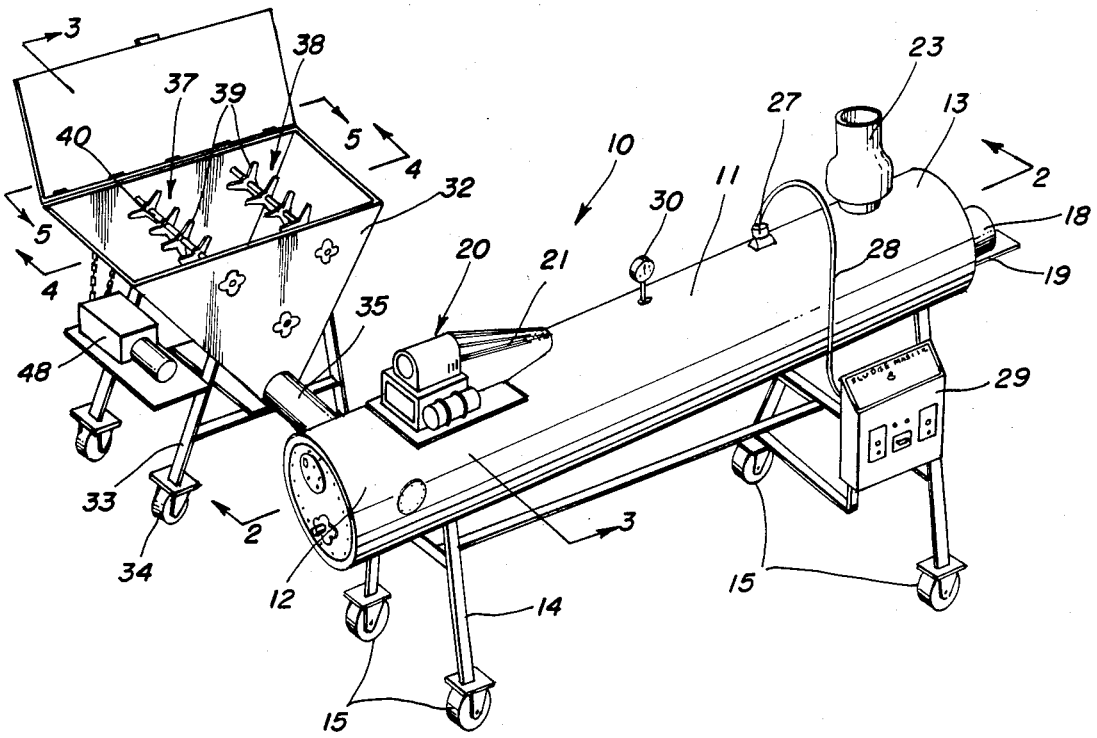
FIG. 1 is a top front perspective view of the apparatus made in accordance with this invention.

Referring now to the drawings in more detail, FIG. 1 discloses an apparatus 10 for carrying out the method of dehydrating a metal hydroxide sludge in accordance with this invention. The apparatus 10 includes an elongated dehydrater chamber 11 preferably in the disclosed cylindrical form, having an inlet end portion 12 and an outlet end portion 13. The dehydrater chamber 11 is preferably mounted upon a mounting frame 14 supported on wheels or casters 15 to facilitate movement of the dehydrater chamber 11 to various locations. The mounting frame 14 also preferably supports the dehydrater chamber 11 so that its longitudinal axis is inclined, as disclosed in FIG. 2, with its outlet end 13 above its inlet end 12.

Mounted in the bottom portion of the chamber 11 is an elongated dryer auger 16 preferably journaled in the end walls of the chamber 11 for rotary movement. The dryer auger 16 is driven by the motor 18 mounted at the outlet end portion 13 of the dehydrater chamber 11 upon a support platform 19.

Figure 2:
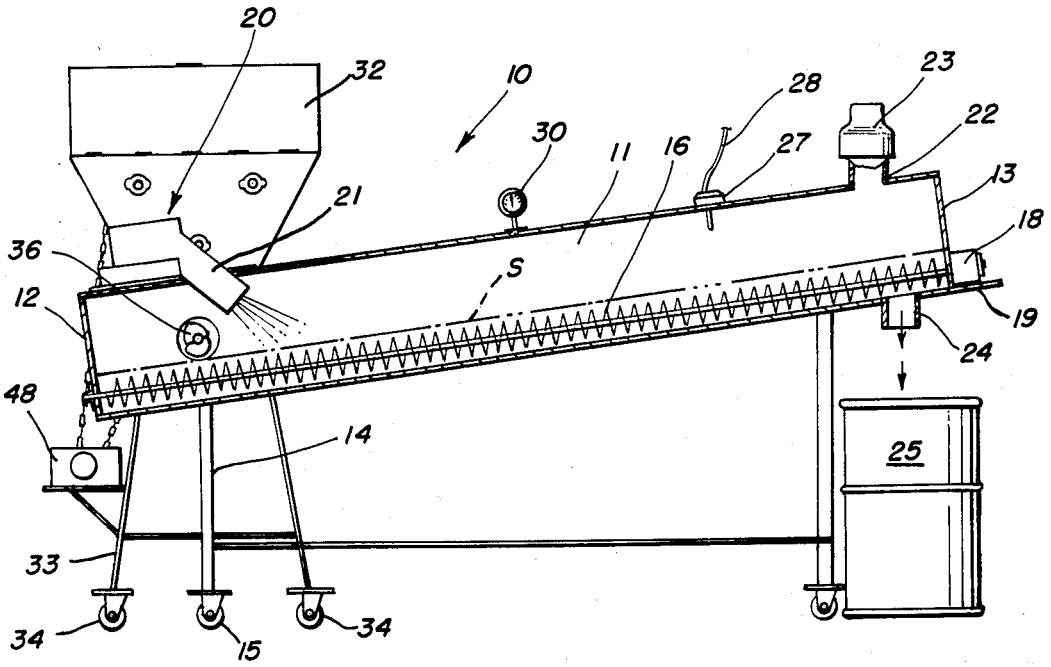
FIG. 2 is a longitudinal section of the dehydrater unit taken along the line 2—2 of FIG. 1.

Mounted on top of the dehydrater chamber 11, adjacent to its inlet end 12 is a conventional gas burner device 20 having means for burning a fuel gas to heat air which is forced through its outlet or discharge nozzle 21 into the inlet portion 12 of the dehydrater chamber 11, as best disclosed in FIGS. 1 and 2.

Although the burner device 20 might be provided with a forced air blower, nevertheless, the natural draft created longitudinally through the dehydrater chamber 11 is generally sufficient for the process of drying the sludge within the dehydrater chamber 11. Adjacent the outlet end portion 13 is an exhaust flue 22 for the moisture-laden hot gases. The exhaust flue 22 may be provided with a condensation collar 23 if desired.

Also, at the outlet end portion of the dehydrater chamber 11 is a discharge port 24 formed in the bottom of the chamber 11 for discharging the solid sludge, after it has been dried, into a receptacle, such as the drum 25 disclosed in FIG. 2. Of course, other types of receptacles might be used, or even a conveyer for receiving and removing the dry contents of the chamber 11.

A conventional temperature sensing device 27 may be located in the top portion of the chamber 11, as illustrated in FIGS. 1 and 2, for controlling the gas burner device 20 to maintain a substantially uniform temperature within the chamber 11. The temperature sensing device 27 is connected through the cable 28 to the control panel 29 so that the regulated temperature within the chamber 11 may be varied. The dehydrater chamber 11 may also be provided with a thermometer or temperature gauge 30, if desired.

Supported behind the dehydrater chamber 11 is a feed hopper 32 supported upon a mounted frame 33 having wheels or casters 34. The bottom portion of the feed hopper 32 is in communication with the inlet end portion 12 of the dehydrater chamber 11 through a conveyer tube 35. Extending longitudinally along the bottom of the feed hopper 32, through the conveyer tube 35, and transversely through the inlet end portion 12 of the dehydrater chamber 11, is a feed auger 36. Although the feed hopper 32 is disclosed behind the dehydrater chamber 11 in the drawings, nevertheless, it will be understood that the feed hopper 32 might occupy several different alternate locations adjacent the inlet end 12 of the chamber 11.

The top or upper end of the feed hopper 32 is open to receive concentrated wet metal hydroxide sludge which has been previously concentrated by, for example, a conventional filter press, not shown.

Preferably, a pair of rotary beaters 37 and 38 having radial blades or vanes 39 projecting from rotary shafts 40 are rotatably mounted parallel to each other and extending longitudinally of the upper portion of the feed hopper 32, as best disclosed in the drawings. When the beaters 37 and 38 are driven, they preferably rotate in opposite directions, as indicated in FIG. 4, in order to agitate, separate and feed downwardly the concentrated mass of the sludge.

Even with the utilization of the rotary beaters 37 and 38, sometimes, bridging of the wet mass of material occurs over the rotary feed auger 36, so that none of the sludge is fed to the dehydrater chamber 11 by the feed auger 36. In order to overcome the problem of tunneling, and also to assist the rotary beaters in breaking the cohesive mass of the wet concentrated sludge, a breaker bar 42 is installed in the intermediate or lower portion of the hopper 32 below the beaters 37 and 38 and directly above the feed auger 36, as best disclosed in FIGS. 3 and 4.

The breaker bar 42 is preferably made in the form of the offset bar 42 in a crank arm design, connected by arms 43 and 44 to the shaft sections 45 journaled for rotation about a horizontal, longitudinal axis in the end walls of the feed hopper 32. The breaker bar 42 is also disposed parallel to the longitudinal axis of the feed auger 36, as illustrated in FIG. 3. When the breaker bar 42 is in its lowermost rotary position, as disclosed, it is proximately spaced to the periphery of the feed auger 36.

When the shaft sections 45 are rotably driven, the breaker bar 42 generates a cylindrical surface of revolution and will sever through any mass of sludge in its rotary path. Thus, when the breaker bar 42 has made a complete revolution through a mass of sludge in its path, that portion of the sludge within its surface of revolution will be completely severed or separated from the remaining mass of the sludge, and being totally unsupported, will drop of its own weight upon the feed auger 36. The feed auger 36 will subsequently feed the severed portion of the sludge through the conveyer conduit 35 into the inlet portion 12 of the dehydrater chamber 11. The breaker bar 42 has proved quite successful in improving the efficiency of the feeding of the sludge through the dehydrater chamber 11.

As disclosed in FIG. 5, the feed auger 36, both rotary beater shafts 40 and the breaker bar shaft sections 45 may all be driven from the same hopper motor 48 through the chain and sprocket transmission 49 disclosed in FIG. 5 to effect the proper rotation for the feed auger 36, the rotary beaters 37 and 38, and the breaker bar 42.

Typical levels of the sludge S are disclosed within the dehydrater chamber 11 of FIG. 2 and also in the feed hopper of FIG. 4.

The operation of the apparatus 10 to carry out the method of dehydrating metal hydroxide sludge in accordance with this invention is apparent from the above description.

The wet metal hydroxide sludge, previously concentrated in the post-treatment of the waste products from a metal finishing process, in a conventional manner, is deposited in the feed hopper 32. Both motors 18 and 48 are energized to drive the respective beaters 37 and 38, the breaker bar 42, the feed auger 36, and the dryer auger 16. Moreover, the combustion of the fuel gas is commenced within the gas burner device 20 to heat the air or other gases which flow longitudinally from the inlet end portion 12 of the chamber 11 to the outlet end portion 13 to thoroughly dry the sludge S transferred by the dryer auger 16. The moisture-laden flue gases will be vented through the exhaust flue 22, while the thoroughly dried sludge S will be discharged through the discharge port 24 into the receptable 25.

The sludge S which is deposited in the feed hopper 32 is agitated and broken up by the combined movements of the rotary beaters 37 and 38 and the breaker bar 42. Moreover, the beaters 37 and 38 cooperate to force the sludge mass between them downward toward the bottom of the hopper 32 for conveyance by the feed auger 36. Furthermore, the breaker bar 42, by completely severing lower portions or masses of the sludge S, facilitates the feeding of the sludge S to the feed auger 36 as well as eliminating the problem of tunneling.

It will be understood that other types of means for heating the gas or air used in the drying of the sludge within the chamber 11 may be utilized instead of the gas burner device 20, such as infrared or electrical heaters.

In the preferred form of the dehydrating method, the operating range within the chamber 11 is maintained at 300°–1600° F., depending upon the degree of drying desired, the size of the chamber 11, the feed rate of the dryer auger 16, as well as the flow rate of the hot gases.

The dehydrater chamber 11 is preferably in cylindrical tubular form, having a diameter of 6–24″ and a length 6–30′.

The dehydration method of this invention is an improvement over the conventional batch dryer processes since the movement of the sludge and the hot gas is continuous, and substantially larger volumes of hot gas in proportion to the sludge is utilized. Furthermore, because of the larger volume of hot gas utilized, the gas is moved at a relatively low velocity.

What is claimed is:

1. An apparatus for dehydrating a sludge comprising:

(a) an elongated dehydrater chamber having an upper portion, a bottom portion, an inlet end, and an outlet end, (b) an elongated dryer auger extending along the bottom portion of said dehydrater chamber from said inlet end toward said outlet end, (c) drive means for said dryer auger to move sludge from said inlet end toward said outlet end, (d) a feed hopper having an upper portion and a bottom portion for receiving sludge, (e) a feed auger in the bottom portion of said feed hopper in communication with said inlet end for feeding sludge from said hopper into the inlet end of said dehydrater chamber, (f) means for driving said feed auger, (g) a rotary breaker bar, (h) means mounting said breaker bar in the lower portion of said feed hopper for rotation parallel about a substantially horizontal rotary axis above said feed auger, (i) drive means for rotating said breaker bar about said rotary axis for separating the lower portion of sludge from the upper portion of the sludge within said feed hopper sufficiently to gravitate toward said feed auger, (j) means for moving hot gas within said dehydrater chamber from said inlet end toward said outlet end to dry said sludge, (k) exhaust means at said outlet end for venting gases from said dehydrater chamber, and (l) said outlet end comprising a discharge port for the sludge dried in said dehydrater chamber.

2. The invention according to claim 1 further comprising rotary beaters mounted in the upper portion of said feed hopper above said breaker bar.

3. The invention according to claim 1 in which said feed auger is mounted to rotate about an auger axis parallel to said rotary axis of said breaker bar.

4. The invention according to claim 1 in which said means for moving hot gas comprising a gas burner device for heating and blowing hot gas into said dehydrater chamber adjacent said inlet end, and means mounting said dehydrater chamber on an inclination so that said outlet end is above said inlet end.

5. The invention according to claim 1 in which said breaker bar comprises a shaft section journaled for rotation about said rotary axis and an offset bar connected to said shaft section and spaced from said rotary axis for revolving about said rotary axis.

6. The invention according to claim 5 in which said offset bar is straight and parallel to said rotary axis for generating a cylinder of revolution about said rotary axis for severing through any mass of sludge in its revolving path.

* * * * *